United States Patent [19]

Kobayashi et al.

[11] Patent Number: 4,547,993

[45] Date of Patent: Oct. 22, 1985

[54] WINDOW REGULATOR

[75] Inventors: Tetuo Kobayashi, Ikeda; Syoichi Hirai, Nishinomiya, both of Japan

[73] Assignee: Nippon Cable System, Inc., Hygo, Japan

[21] Appl. No.: 527,384

[22] Filed: Aug. 29, 1983

Related U.S. Application Data

[63] Continuation of Ser. No. 275,148, Jun. 19, 1981, abandoned.

[30] Foreign Application Priority Data

Feb. 27, 1981 [JP] Japan ..... 56-28256

[51] Int. Cl.[4] ..... E05F 11/48

[52] U.S. Cl. ..... 49/352; 49/360

[58] Field of Search ..... 49/352, 360, 349

[56] References Cited

U.S. PATENT DOCUMENTS

| | | | |
|---|---|---|---|
| 1,503,500 | 8/1924 | Heintz | 49/352 X |
| 3,022,064 | 2/1962 | Russell | 49/352 X |
| 3,681,874 | 8/1972 | Golde et al. | 49/352 |
| 4,001,971 | 1/1977 | Gobush et al. | 49/352 |
| 4,020,593 | 5/1977 | Salomon et al. | 49/352 X |
| 4,109,417 | 8/1978 | Fogarollo | 49/352 |
| 4,235,046 | 11/1980 | Hess et al. | 49/352 |
| 4,237,656 | 12/1980 | Hess et al. | 49/352 |

FOREIGN PATENT DOCUMENTS

| | | | |
|---|---|---|---|
| 2802563 | 7/1979 | Fed. Rep. of Germany | 49/352 |
| 2831870 | 2/1980 | Fed. Rep. of Germany | 49/352 |

*Primary Examiner*—Philip C. Kannan

*Attorney, Agent, or Firm*—Armstrong, Nikaido, Marmelstein & Kubovcik

[57] ABSTRACT

A window regulator employing a flexible control cable as a transmission means, comprising a bracket secured to a window glass, an operating means and an inner cable connecting the bracket and the operating means through conduits, and both end portions of the inner cable being respectively wound up and off in the operating means to slidably move the bracket along a guide rail in order to perform an opening or closing action of the window glass, whereby a light, small and simple regulator is provided.

3 Claims, 2 Drawing Figures

WINDOW REGULATOR

This application is a continuation of application Ser. No. 275,148, filed June 19, 1981 now abandoned.

BACKGROUND OF THE INVENTION

The present invention relates to a window regulator employing a control cable, and more particularly to the regulator for performing a slidably opening or closing action of a window glass in an automobile or the like by employing the control cable as a transmission means.

It is well known in a window regulator that gears are used in an operating side for moving the window glass upwardly or downwardly with arms. This well-known device, because of using a large number of steel-pressed parts, results in a complicated mechanism, a high expense for producing, and entirely heavy and large device.

In order to exclude these disadvantages, various devices employing a threaded or geared cable have been suggested. For example, a window regulator suggested by U.S. Pat. No. 4,020,593 includes an actuating device having a slotted guide tube with the flexible threaded cable slidably guided in the tube by a tension and compression transmitting relationship. This device, however, has a large volume due to essentially requiring the non-flexible guide tube curved in a predetermined form. Therefore, the device requires a large cut-away area in a door panel, and further brings the most difficulty to attach it within a door. In addition, the slidable movement of the threaded cable in the guide tube cannot avoid generation of noise every operation of the regulator due to slidably contacting of helical teeth provided on the threaded cable with the guide tube, and becomes one of the reasons giving uncomfortableness to the passengers in the automobile.

On the other hand, U.S. Pat. No. 4,001,971 suggests a window regulator employing a wire. However, in this suggested device, the tension adjustment of the wire is required after setting a mechanism for winding up or off the wire (operating means) and a guide rail into a door of the automobile, and further a wide space for attaching the device is required due to substantially using the long wire to be arranged over a wide range.

OBJECT OF THE INVENTION

The main object of the invention is to provide a window regulator employing a control cable as a transmission means, consisting of a small number of parts to give light weight, and being cheaply produced.

The other object of the invention is to provide a window regulator which can facilitate its attachment in a door of an automobile and perform a small cutting area of a door panel for inserting and attaching it.

The further other object of the invention is to provide a window regulator of which an attachment position is freely determined within the door, and which can be used in common to the various types of vehicles.

Other objects and advantages of the invention will become apparent from the following description.

DETAILED EXPLANATION OF THE INVENTION

Figure 1:
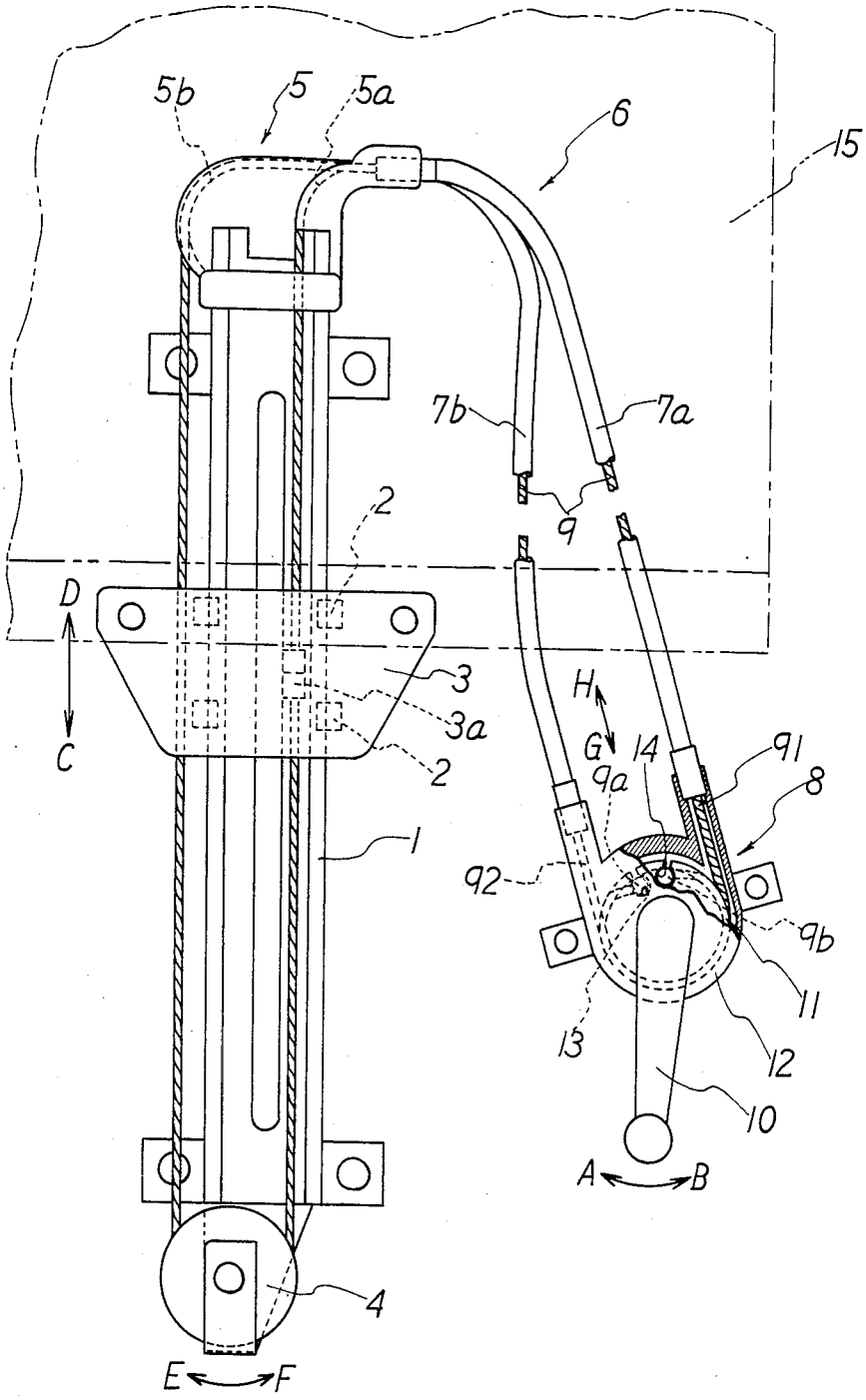
FIG. 1 is a front view partially broken away for showing an embodiment of a window regulator of the present invention.
Figure 2:
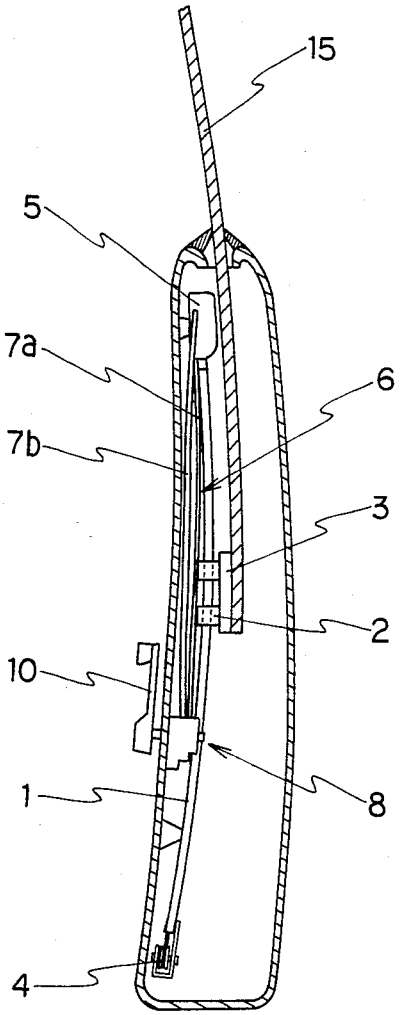
FIG. 2 is a schematically side view for showing the state that the window regulator shown in FIG. 1 is attached within a door of an automobile.

With reference to FIGS. 1 to 2, indicated as 1 is a guide rail which is secured to an inner side of a door in an automobile as shown in FIG. 2. Indicated as 3 is a bracket having a slide shoe 2 slidably moving along the guide rail 1.

The guide rail 1 has at one end thereof a pulley 4 being rotatable, and at other end thereof a cable guide 5. An end of the cable guide 5 is secured to each end of two conduits 7*a* and 7*b* in a control cable 6. A casing 12 in an operating means 8 is secured to other ends of the conduits 7*a* and 7*b*, and an operating pulley 11 rotated by a lever 10 is secured within the casing 12.

One end portion 91 of a flexible inner cable 9 such as wire, which is secured at top end 9*a* in a recess 13 provided on the operating pulley 11, and which is suitably wound around the operating pulley 11, is extended to a first cable groove 5*a* through the conduit 7*a*, and further extended to a fitting 3*a* of the bracket 3 along the guide rail 1 with a certain gap against the guide rail 1. The other end portion 92 of the inner cable 9 which is secured at top end 9*b* in the other recess 14 provided on the operation pulley 11, and which is suitably wound in opposite direction of the above one top end 9*a*, is inserted into conduit 7*b*, extended through a second guide groove 5*b* to the pulley 4 along the guide rail 1 with a certain gap, and further turned on the pulley 4, which is rotatably engaged with the inner cable, to extend to the fitting 3*a* of the bracket 3.

The fitting 3*a* secures each end of the inner cable 9 at its upper and lower portions, or is secured to the continuous inner cable. Thus, the inner cable 9 is endlessly formed by extending from the operating means 8 successively through one conduit 7*a* of the control cable and the first guide groove 5*a* to the fitting 3*a*, and then returning from the fitting 3*a* successively through the pulley 4, the second guide groove 5*b* and the other conduit 7*b* of the control cable to the operating means 8.

As conduits 7*a* and 7*b*, a flexible conduit such as a spiral metal tube having a coating layer such as polyvinyl chloride on its outer surface is preferably employed. The inner cable 9 is inserted into the conduits 7*a* and 7*b* as mentioned above to form the control cable 6. This kind of control cable is generally called as a pull cable, is secured to a lever at one end and to a working device at the other end so as to widely use for remote control in various industrial machines or automobiles. On the other hand, according to the invention, the inner cable 9 to be inserted into the conduits 7*a* and 7*b* is endlessly formed so as to slidably move the bracket along the guide rail 1 by winding-up and winding-off of the inner cable 9 resulting from the rotation of the operating pulley 11 in order to perform a slidable opening or closing action of a window glass 15.

Hereinafter, the functions and advantages of the window regulator of the invention will be explained in detail.

When the lever is rotated in the direction A as shown in FIG. 1, the operating pulley 11 is also rotated in the direction A, and as a result, one end portion 91 of the inner cable is wound up around the operating pulley 11 to slidably move in the direction G. Simultaneously, the other end portion 92 of the inner cable is wound off from the operating pulley 11 in the direction H. Thus, the bracket 3 in which the inner cable is secured is slidably moved to transfer the window glass 15 in the direction D, therefore being able to close the window.

On the other hand, in the case of opening the window, the above lever 10 is rotated in the direction B as shown in FIG. 1. As a result, one end portion 91 of the inner cable 9 is wound off, and the other end portion 92 of the inner cable 9 is wound up, whereby the bracket 3 is moved in the direction C to open the window.

As mentioned above, the device of the invention can be mechanically simplified with a small number of parts by using the control cable 6 as a transmission means in comparison with a conventional device.

In addition, the device of the invention can be more lightened in weight than the conventional device of an arm system. For example, in a compact car, the device of the invention is about 620 g in weight, and is approximately half weight against the conventional device of the arm system which is 1200 to 1300 g in weight. This result is most advantageous for contribution to cut automobile weight in view of the saves of energy and resource which are strongly appealed in recent year.

Also, in comparison with the conventional device, the device of the invention can be simply attached within the door, and further can perform its convenient insertion and attachment within the door even if the cut-away area of the door panel is limited to narrow area in connection with strength, since both the guide rail portion and the operating means portion are connected by the flexible control cable. Furthermore, the device of the invention can be economically used in common over all of various types of automobiles.

Furthermore, though the conventional device of a wire system should be attached in plane or two dimensions, and therefore brings difficulties to its attachment, according to the invention, both the guide rail portion and the operating means portion are attached in three dimensions as shown in FIG. 2 due to using the flexible control cable.

What is claimed is:

1. A unitary regulator employing a control cable as a transmission means, comprising a control cable including an inner cable and two flexible conduits;

at least one rigid guide rail having opposite ends;

a bracket having a slide shoe which is slideable along the guide rail in connection with winding operation of the inner cable and securable to a window glass;

a pulley rotatably provided to one end of the guide rail, the inner cable being slideably engaged with the pulley;

an L-shaped curved cable guide having two ends at a right angle to each other, one end being secured to the other end of the guide rail, a curved first open guide groove and a curved second open guide groove being formed on the cable guide extending from one end to the other end, the inner cable being guided along the guide grooves and deflected at an angle away from a longitudinal axis of said guide rail, the two conduits of the control cable being rigidly secured to the other end of the cable guide, one end of one of the conduits communicating with the first guide groove and one end of the other conduit communicating with the second guide groove, the inner cable extending through the conduits; and an operating means for performing simultaneously winding-up and winding-off actions of both end portions of the inner cable, the other end of each of the conduits being rigidly secured to the operating means thereby enabling tension of the inner cable set before installation to be maintained during installation of said window regulator;

the operating means, the inner cable, the conduits, the cable guide, the guide rail and the pulley being preformed as a unitary structure having a generally inverse-J shape prior to installation in a door panel of a vehicle, and the window glass subsequent to installation being movable along the guide rail in response to the winding-up and winding-off actions of both end portions of the inner cable in the operating means.

2. The window regulator of claim 1 wherein said operating means comprises a casing secured to said other ends of the conduits, an operation pulley rotatably secured in said casing and securing both top ends of the inner cable, and a lever for rotating said operating pulley.

3. The window regulator of claim 2 wherein said both top ends of the inner cable are respectively secured in two recesses provided on said operating pulley, and both end portions of the inner cable are wound around the operating pulley in opposite direction to each other.

* * * * *